US006971527B2

(12) United States Patent
Chandaria

(10) Patent No.: US 6,971,527 B2
(45) Date of Patent: Dec. 6, 2005

(54) DISPLAY SYSTEM FOR RETAIL PACKAGING WITH INCLUDED KEYHOLE SLOT

(76) Inventor: Ashok V. Chandaria, P.O. Box 48020, Nairobi (KE)

( * ) Notice: Subject to any disclaimer, the term of this patent is extended or adjusted under 35 U.S.C. 154(b) by 18 days.

(21) Appl. No.: 10/424,438

(22) Filed: Apr. 28, 2003

(65) Prior Publication Data

US 2004/0211735 A1 Oct. 28, 2004

(51) Int. Cl.[7] ..... A47F 7/00

(52) U.S. Cl. ..... 211/13.1; 211/113; 211/73; 40/657

(58) Field of Search ..... 211/13.1, 57.1, 211/54.1, 72, 73, 87.01, 113, 126.16, 86.01, 211/70.1, 59.3, 59.1; 248/220.31, 220.22, 248/224.51, 222.41, 317, 318; 206/45.25, 206/45.27, 45.29, 45.3, 175, 176, 193, 362.4, 206/385, 784, 525.1, 750, 526, 391, 461, 206/806, 408, 415, 416, 483; 40/124.4, 657, 40/673, 617, 618

(56) References Cited

U.S. PATENT DOCUMENTS 1,909,474 A * 5/1933 Keppler ..... 206/762
2,324,232 A * 7/1943 Pantalone ..... 211/73
3,069,019 A * 12/1962 Schuster ..... 211/73
3,159,368 A * 12/1964 Ahlbin et al. ..... 248/222.41
3,186,557 A * 6/1965 Wise ..... 211/86.01
3,397,796 A * 8/1968 Watts ..... 211/73
3,880,396 A * 4/1975 Freiberger et al. ..... 248/475.1
4,201,291 A * 5/1980 Davidson ..... 206/768
5,595,309 A * 1/1997 Bauer et al. ..... 211/59.1
5,738,020 A * 4/1998 Correia ..... 109/51
5,785,190 A * 7/1998 Otema ..... 211/189
6,085,916 A * 7/2000 Kovacevic et al. ..... 211/86.01
6,749,161 B1 * 6/2004 Will et al. ..... 248/222.51

* cited by examiner

*Primary Examiner*—Jennifer E. Novosad

(74) *Attorney, Agent, or Firm*—Sand & Sebolt

(57) ABSTRACT

A display system for displaying retail products which includes a display board and at least one package One of the display board and package includes a peg engageable in a keyhole-shaped slot in the other of the display board and package. The package is formed from a blank which includes a plurality of fold lines and tabs. The product is placed on the blank and the blank is folded around the product. Tabs are secured together to lock the package in place. The display board includes at least one hole near its uppermost edge to hang it from a display in a retail environment.

20 Claims, 12 Drawing Sheets

DISPLAY SYSTEM FOR RETAIL PACKAGING WITH INCLUDED KEYHOLE SLOT

BACKGROUND OF THE INVENTION

1. Technical Field

This invention generally relates to retail display and packaging systems. More particularly, the invention relates to a display and packaging system that include a cooperative peg and keyhole slot on the package and display board. Specifically, the invention relates to a display system that includes a cardboard blank which is folded directly around the product during manufacture to form a package which is then engaged with a display board.

2. Background Information

A wide variety of display systems have been provided in the retail sector for displaying various products to potential consumers. Retailers have frequently used display boards in the form of clip strips or clip sheets for displaying products that are too small to place on shelves or that are seasonal in nature. The strips or sheets are hung on other product displays or on shelf supports so that they do not take up valuable shelf space. These clip strips and sheets are typically manufactured from a lightweight plastic that has been die-cut to produce a plurality of upwardly extending pegs that are each flanked by two downwardly extending legs. The products for display need to be mounted onto a cardboard backing sheet that includes an hole toward its upper end. The peg of the clip strip is inserted through the hole and the legs engage over a portion of the uppermost end of the cardboard backing sheet. In this manner the product is attached to the clip strip or sheet. The attachment of the products onto the clip strip or sheet is a labor intensive operation inasmuch as every single product has to manually be mounted onto a peg on a clip strip. Once the products are mounted onto the clip strips or sheets, they are packaged and sent to the retailer. During transit, the products tend to become disengaged from the pegs. It is not uncommon for retailers to find that around 50% of the products have become detached from the clip sheets or strips. It is then up to the retailer to reinstall the products onto the strips. The clip strips or sheets are then hung onto the displays or shelf supports so that consumers can see them.

Apart from the disengagement of the products from previously known display boards during shipping, these products have also had other disadvantages for the retailer. The first of these is that a fairly limited number of products may be displayed on any one clip strip or sheet. Secondly, when consumers remove the products from the clip strips, they may accidentally disengage other products from the strip. Once a peg has been used, it tends to become slightly deformed and consequently if a consumer attempts to reattach products onto the clip strip, they tend to fall off again. After a few attempts the consumer is likely to give up and place the product on another shelf. This leaves the retailer with the problem of not having products adequately on display in the store and having to repeatedly reattach products onto the strips or sheets. Even if the products remain on the sheets, the displays tend to be messy in appearance. This does not enhance the aesthetic appeal of the clip strip display and does not aid in selling the product.

Several devices have been developed to address these problems. These devices have included metal rods with metal clamps mounted on them or thin metal strips with upwardly extending metal hooks. In some instances, like the device with metal clamps, the problem of products disengaging during shipping have been greatly reduced. The devices are, however, far more expensive to manufacture and still require the manual installation of products.

It is common in the art to package products in boxes for both shipping and display purposes. A typical packaging process requires several steps, including cutting out blanks for a box, assembling a box from the blank, placing the product into the box, sealing the box and then shipping the same to the retailer. The more steps involved in the process, the more expensive the process becomes.

There is therefore still a need in the art for an inexpensive system for both packaging and displaying products.

It is an object of the present invention to provide a system for packaging that includes building the package or box directly around the product. It is a further object of the present invention to provide a system for displaying the package that allows for easy and rapid engagement between the assembled package and cooperative display card.

BRIEF DESCRIPTION OF THE DRAWINGS

The preferred embodiment of the invention, illustrative of the best mode in which applicant has contemplated applying the principles, is set forth in the following description and is shown in the drawings and is particularly and distinctly pointed out and set forth in the appended claims.

DETAILED DESCRIPTION OF THE INVENTION

Figure 1:
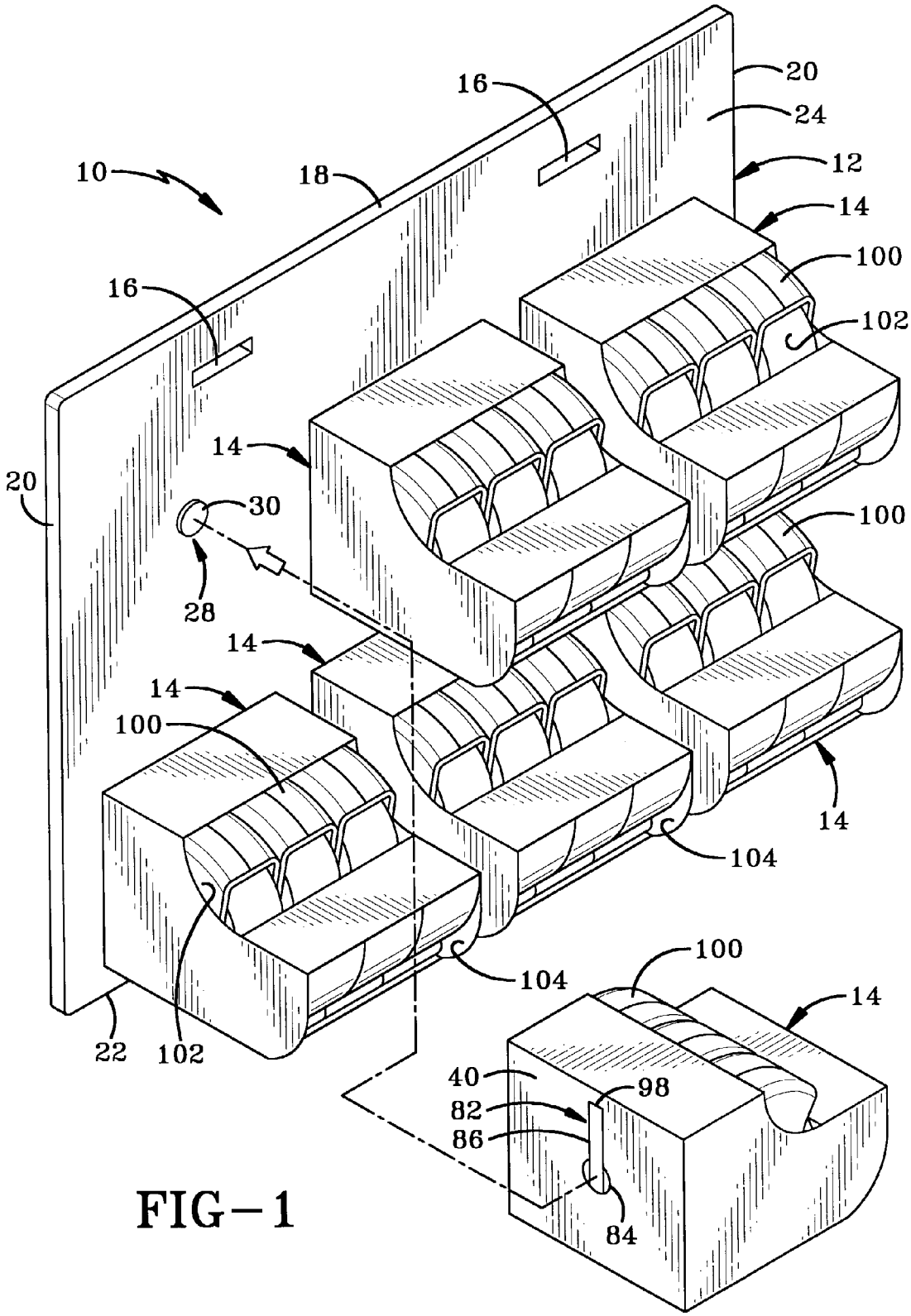
FIG. 1 is a perspective view of the display system in accordance with the present invention showing the display board and the packages for engagement thereon.
Figure 2:
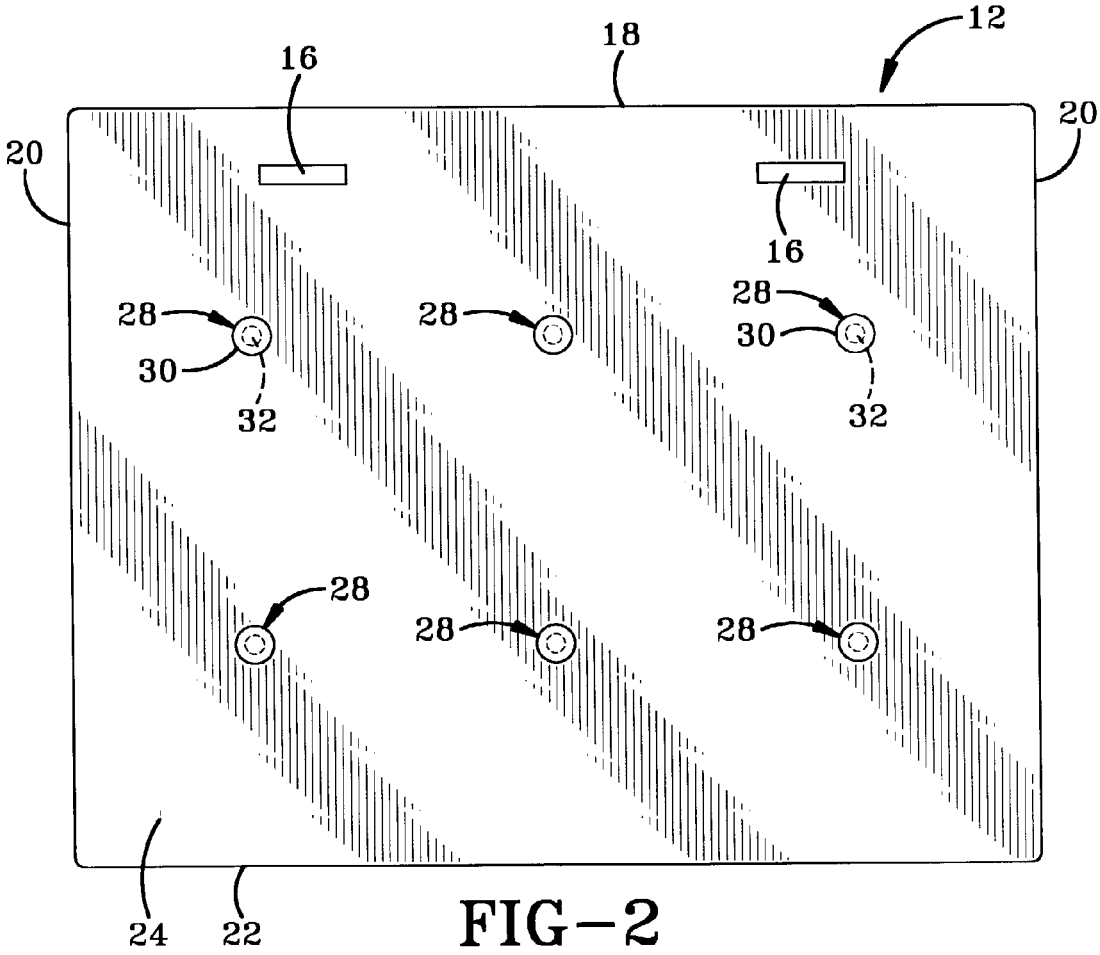
FIG. 2 is a front view of a display board.
Figure 3:
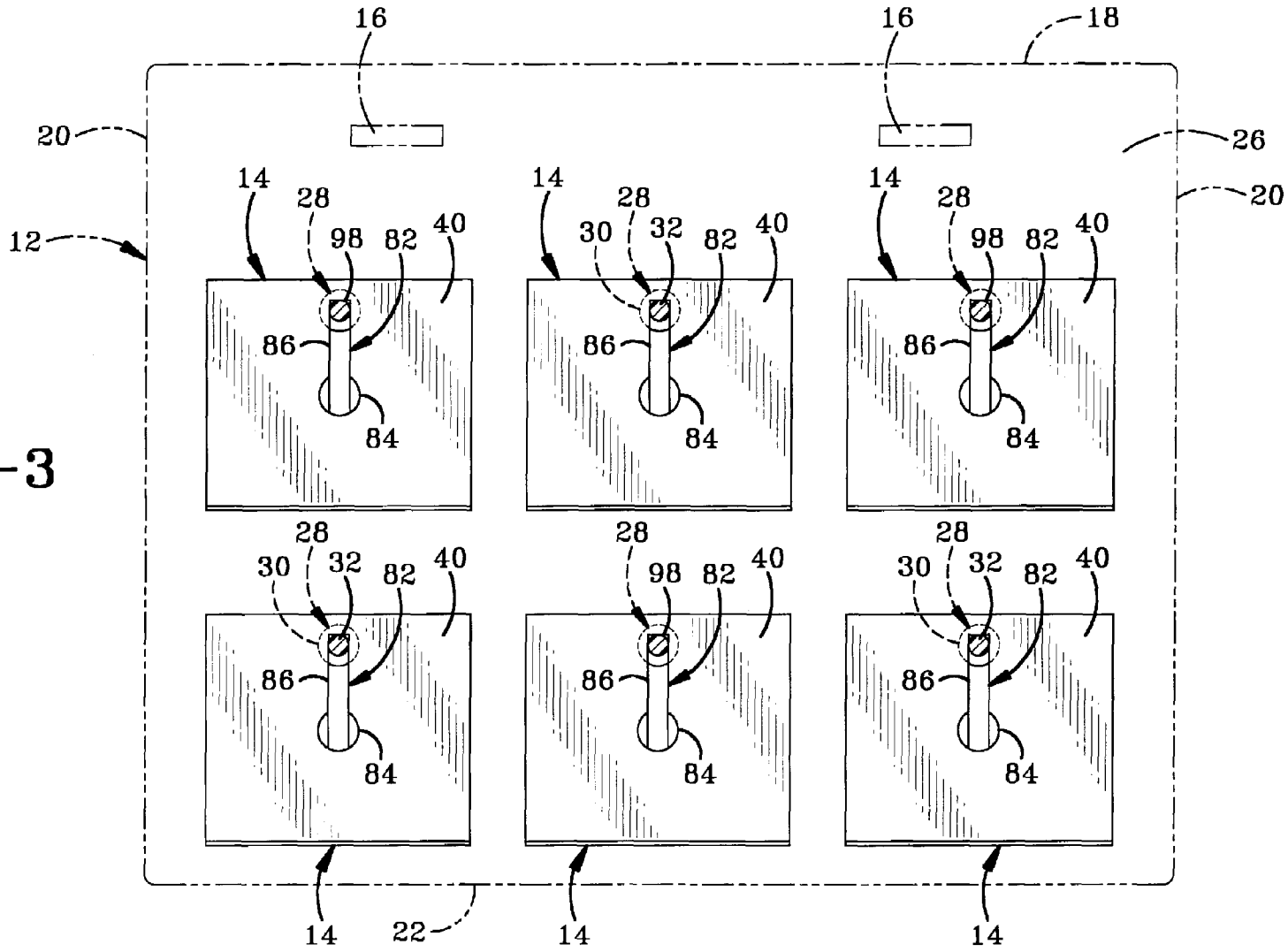
FIG. 3 is a cut-away rear view of a plurality of packages engaged on the display board.
Figure 4:
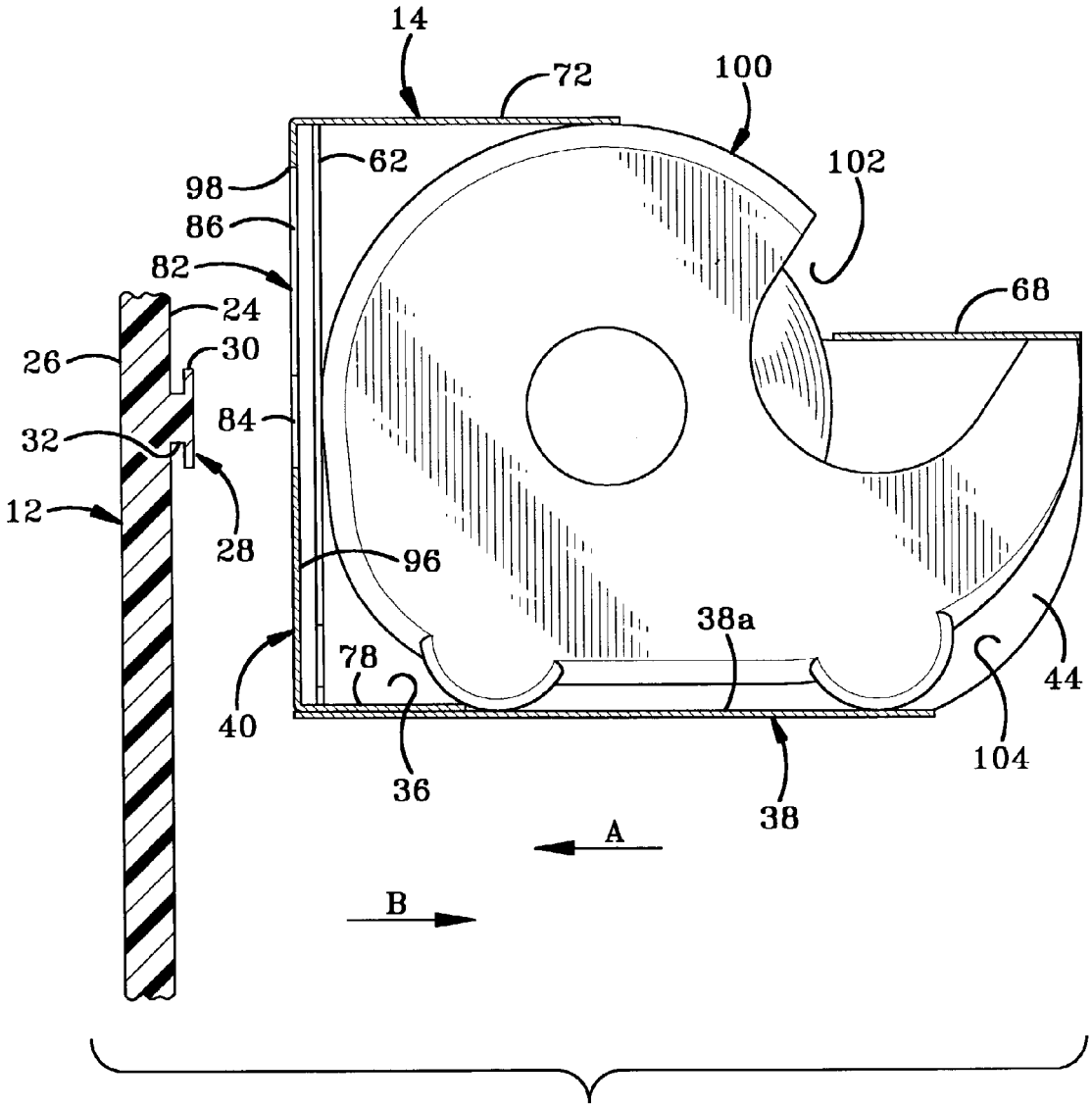
FIG. 4 is a partial cross-sectional side view of the package and display board prior to engagement.

Referring to FIGS. 1–7, there is shown a display system for retail packaging in accordance with the present invention, which system is generally referred to by the number 10. Display system 10 includes a display board 12 and at least one package 14 for holding products 100 for sale. Display board 12 includes at least one hole holes 216 proximate its upper edge 18 which allows it to be hung from a hook or similar device (not shown) of a retail merchandising rack.

Display board 12 is preferably molded from a rigid plastic but any other suitable material may be utilized for this purpose. Board 12 has an upper edge 18, side edges 20, bottom edge 22, front surface 24 and back surface 26. A plurality of package-engaging pegs or buttons 28 are disposed on front surface 24. Buttons 28 extend outwardly from front surface 24 and each button includes a head piece 30 and a shaft 32. As may be most clearly seen from FIGS. 4–7 buttons 28 are preferably integrally formed with front surface 24. Head piece 30 has a greater diameter than does shaft 32. Alternatively, a peg may be inserted through display board 12 so that the button 28 is disposed proximate the front surface 24 of board 12. While head piece 30 is shown as being circular in shape, it will be understood by those skilled in the art that any shape head piece may be utilized, such as a square, without departing from the scope of the present invention. Similarly, while shaft 32 is shown as being cylindrical, it can of course be manufactured with any cross-sectional shape, such as a square cross section. However, the width of shaft 32 should be smaller than the width of head piece 30.

Package 14 is adapted to hold a product 100 therein. While any product may be held inside package 14, the product shown in the attached figures is a plurality of adhesive tape dispensers. Referring to FIGS. 4–8 it will be seen that package 14 is made up from a cardboard blank, generally referred to by the number 34. Blank 34 has a plurality of sections that are interposed with fold lines. When blank 34 is folded around product 100, a generally cubic-shaped package 14 is formed. Package 14 has an interior cavity 36 in which product 100 is contained.

Figure 8:
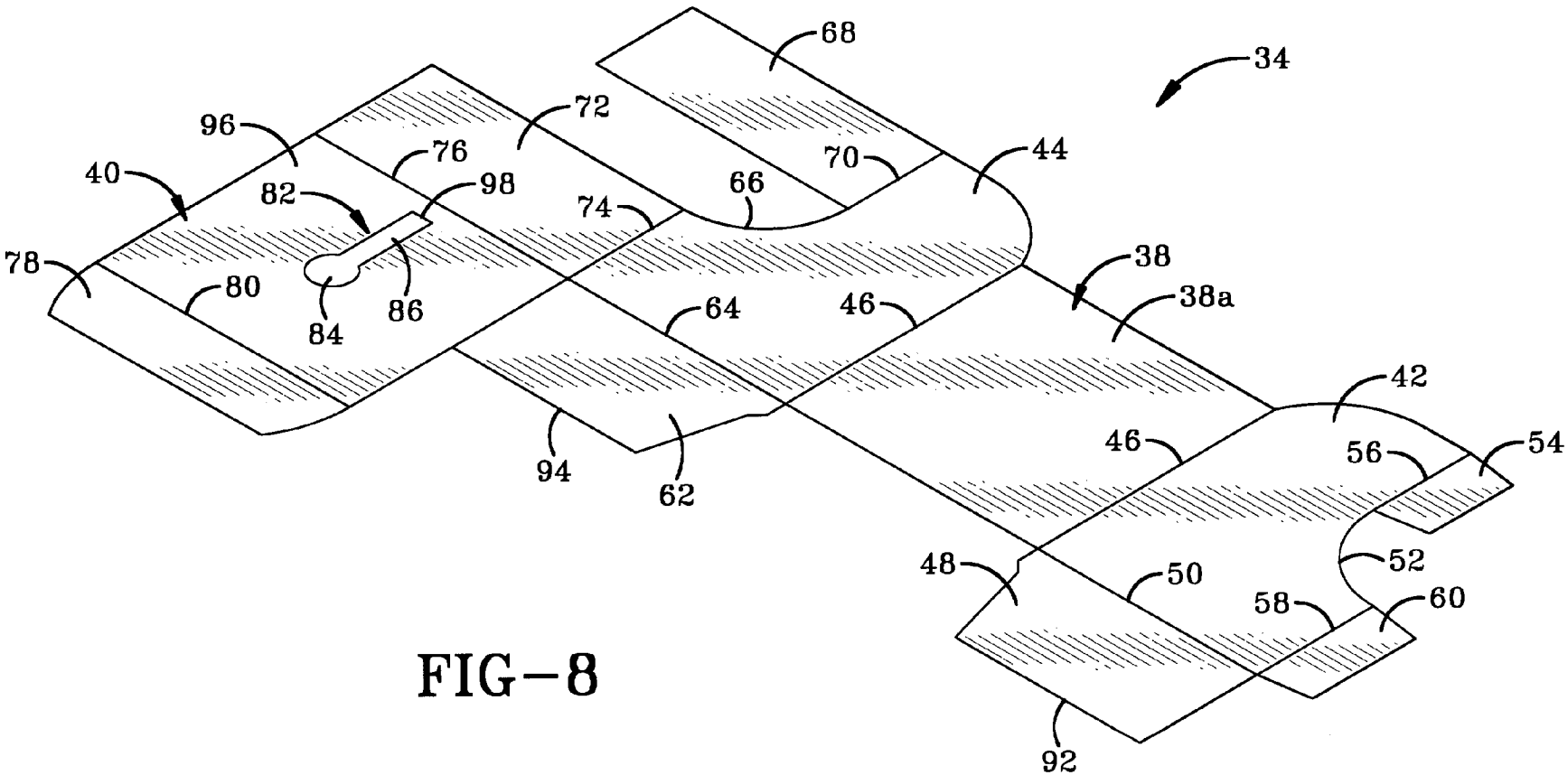
FIG. 8 is a perspective view of the package in the unfolded state.

Referring to FIG. 8, blank 34 has a base 38, a rear 40, a first side 42 and a second side 44. Base 38 and rear 40 are generally square-shaped. Base 38 is disposed intermediate first side 42 and second side 44 and side fold lines 46 are disposed between base 38 and each of first and second side 42, 44. A first tab 48 extends from first side 42 and a rear fold line 50 is disposed therebetween. First side 42 includes a curved side wall 52 and a second tab 54 extends therefrom Second tab 54 is foldable about a first side fold line 56. First side 42 further includes a second side fold line 58 and a third tab 60 extends therefrom. A fourth tab 62 extends from second side 44 and a rear fold line 64 is disposed therebetween. Second side 44 also includes a curved side wall 66 and a fifth tab 68 extends therefrom. A third fold line 70 is disposed between the fifth tab 68 and second side 44. A sixth tab 72 extends from second side 44 and a fourth fold line 74 is disposed therebetween. Rear 40 extends from sixth tab 72 and a front fold line 76 is disposed therebetween. A seventh tab 78 extends from rear 40 and a rear fold line 80 is disposed therebetween.

In accordance with the invention, rear 40 defines a keyhole-shaped slot therein, said keyhole slot being generally referred to by the number 82. Keyhole slot 82 includes a rounded area 84 integrally formed with a slotted area 86. While area 84 is disclosed as being rounded, it may be configured to any other shape suitable to receive button 28 therethrough. For example, if head piece 30 of button 28 is square in shape, area 84 could similarly be square in shape. Area 84 is configured to be slightly larger than head piece 30 and slotted area 86 is configured to be slightly wider than shaft 32. The width of area 84 is greater than the width of slotted area 86.

Figure 9:
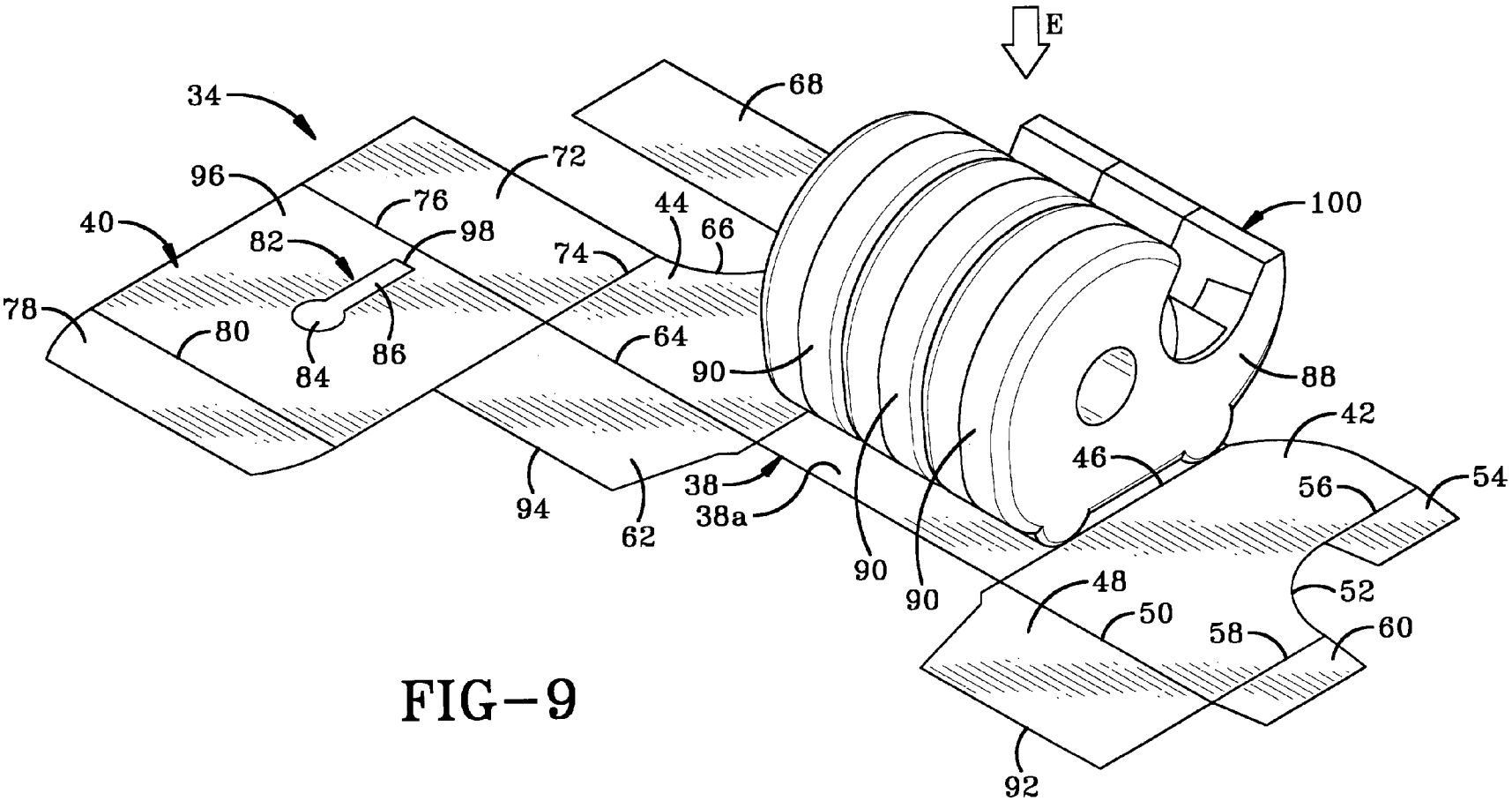
FIG. 9 is a perspective view of the package showing the product being positioned onto the blank prior to folding.
Figure 10:
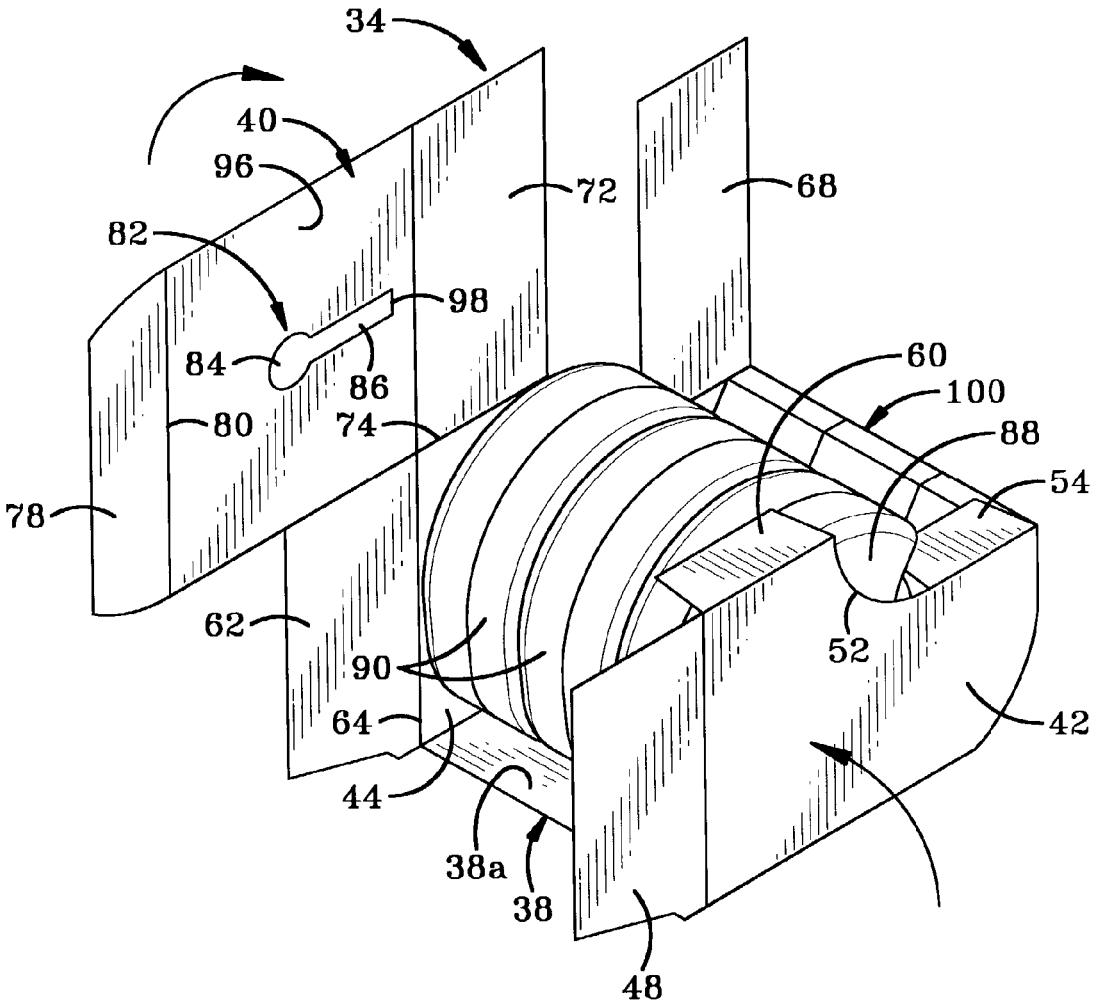
FIG. 10 is a perspective view of the package showing the sides of the blank being folded around the product.
Figure 11:
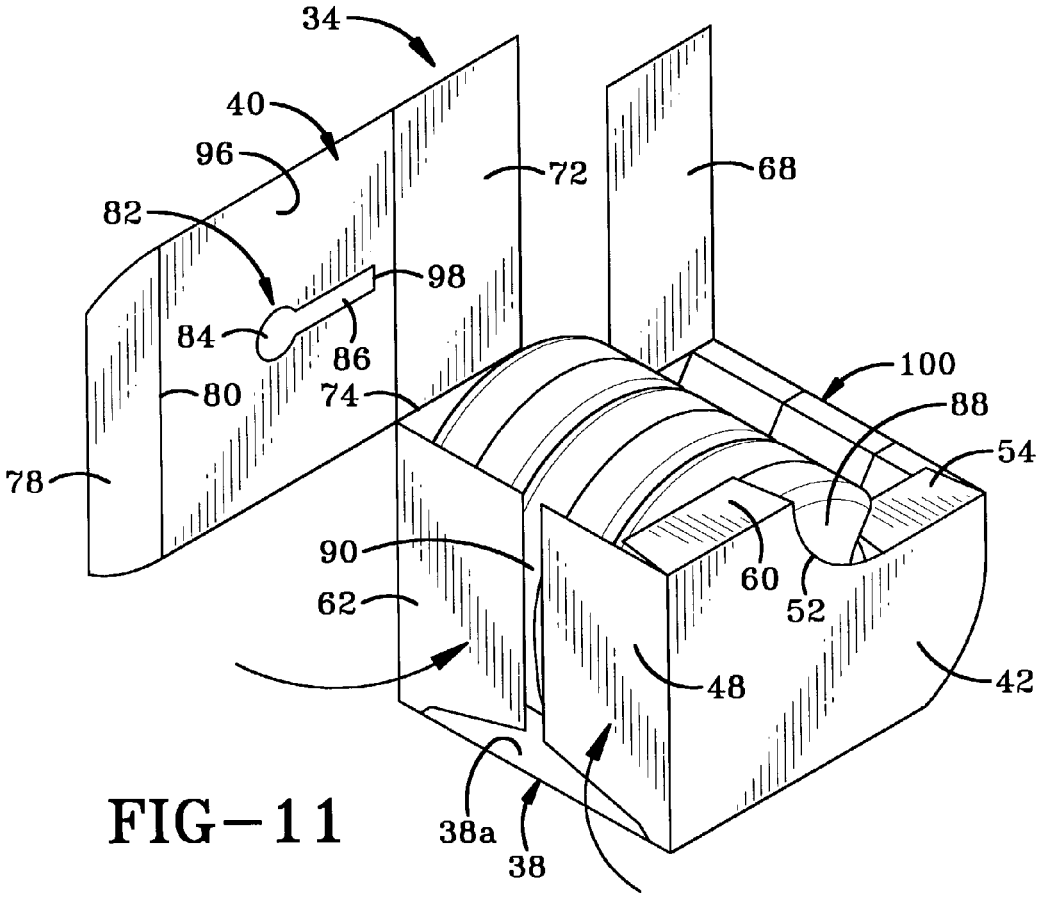
FIG. 11 is a perspective view of the package showing the progressive folding of the blank to cover the back of the product.
Figure 12:
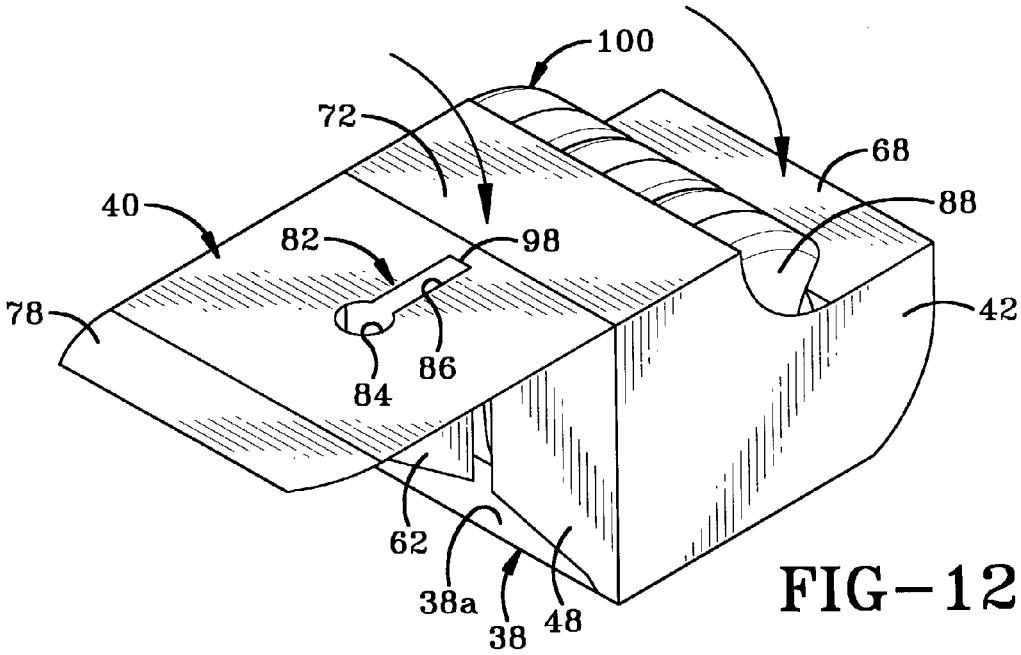
FIG. 12 is a perspective view of the package showing the progressive folding of the blank to partially cover the top of the product.
Figure 13:
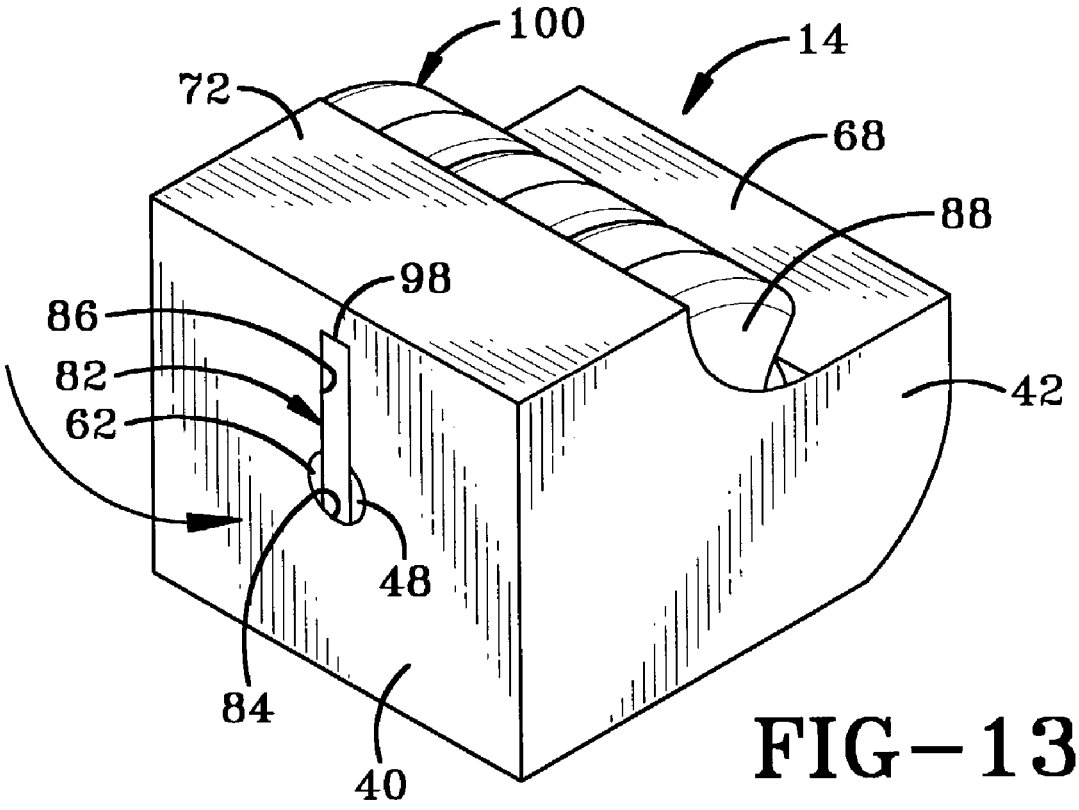
FIG. 13 is a perspective view of the package showing the folding down of the back flap of the blank.

Referring to FIGS. 8–13, when blank 34 is to be folded around product 100, product 100 is lowered onto base 38 in the direction of Arrow E (FIG. 9). Referring to FIG. 10, first and second sides 42, 44 are folded upwardly into contact with the side walls 88 of product 100 and second and third tabs 54, 60 are folded inwardly over product 100. First tab 48 and fourth tab 62 are folded inwardly to contact rear surfaces 90 of product 100 (FIG. 11). Fifth tab 68 and sixth tab 72 are folded inwardly over product 100 and tabs 68, 72 cover second tab 54 and third tab 60 (FIG. 12). A small quantity of adhesive (not shown) is applied to one of second and fifth tabs 54, 68 to bond them together. Similarly, a small quantity of adhesive (not shown) is applied to one of third and sixth tabs 60, 72 to bond them together. Rear 40 is folded downwardly and inwardly over rear surfaces 90 and first and fourth tabs 48, 62 (FIG. 13) and seventh tab 78 is then tucked into cavity 36 (shown in FIG. 4) so that seventh tab 78 lies in contact with the inner surface 38*a* of base 38. As may be seen from FIG. 13, when first and fourth tabs 48, 62 are folded over rear surfaces 90, their ends are disposed a spaced distance apart from each other so that slotted area 86 is not obstructed. As may be seen from FIGS. 1 and 4, when blank 34 is folded around product 100 to form package 14, two windows 102, 104 are formed in package 14. Windows 102, 104 allow consumers to view a part of the product 100 held within package 14.

Referring to FIGS. 4–7 when it is desired to place package 14 onto display board 12, rear 40 of package 14 is moved in the direction of Arrow A and is brought into proximity with front surface 24 of display board 12. Rounded area 84 is brought into the proximity of head piece 30 of button 28. Package 14 is pushed into contact with front surface 24 so that head piece 30 is received through rounded area 84. In this position, head piece 30 lies between the interior surface 96 of rear 40 and the rear surface 90 of product 100. Package 14 is then moved downwardly in the direction of Arrow C. This relative movement causes the rounded area 84 and then slotted area 86 to move downwardly with respect to head piece 30 and shaft 32. At this point, head piece 30 cannot be easily removed from slotted area 86 because the width of head piece 30 is greater than the width of slotted area 86. The downward movement of package 14 is continued until shaft 32 abuts the end 98 of slotted area 86. Package 14 is then suspended from display board 12.

Figure 5:
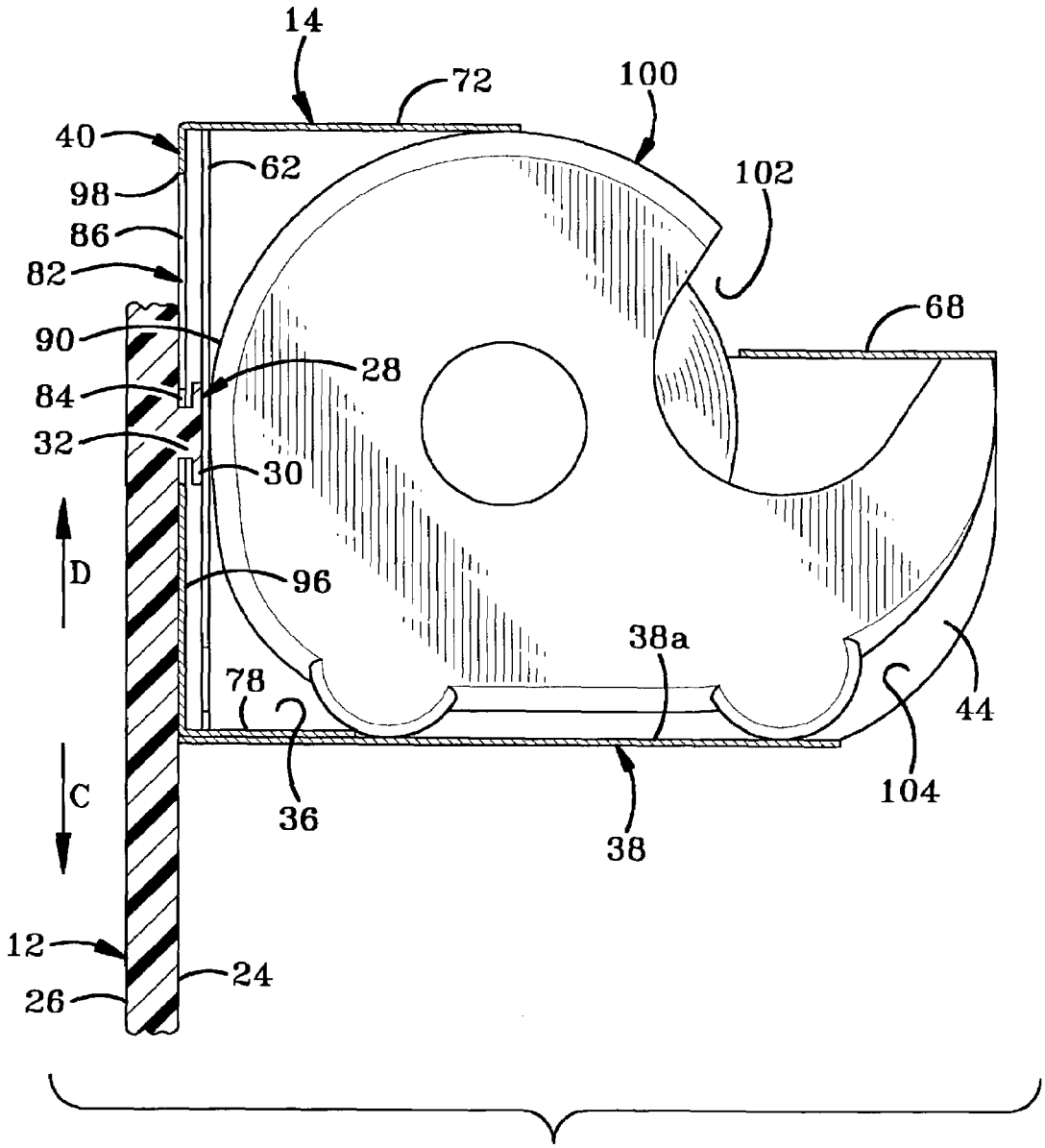
FIG. 5 is a partial cross-sectional side view of the package when the peg from the display board is initially inserted into the slot on the package.
Figure 6:
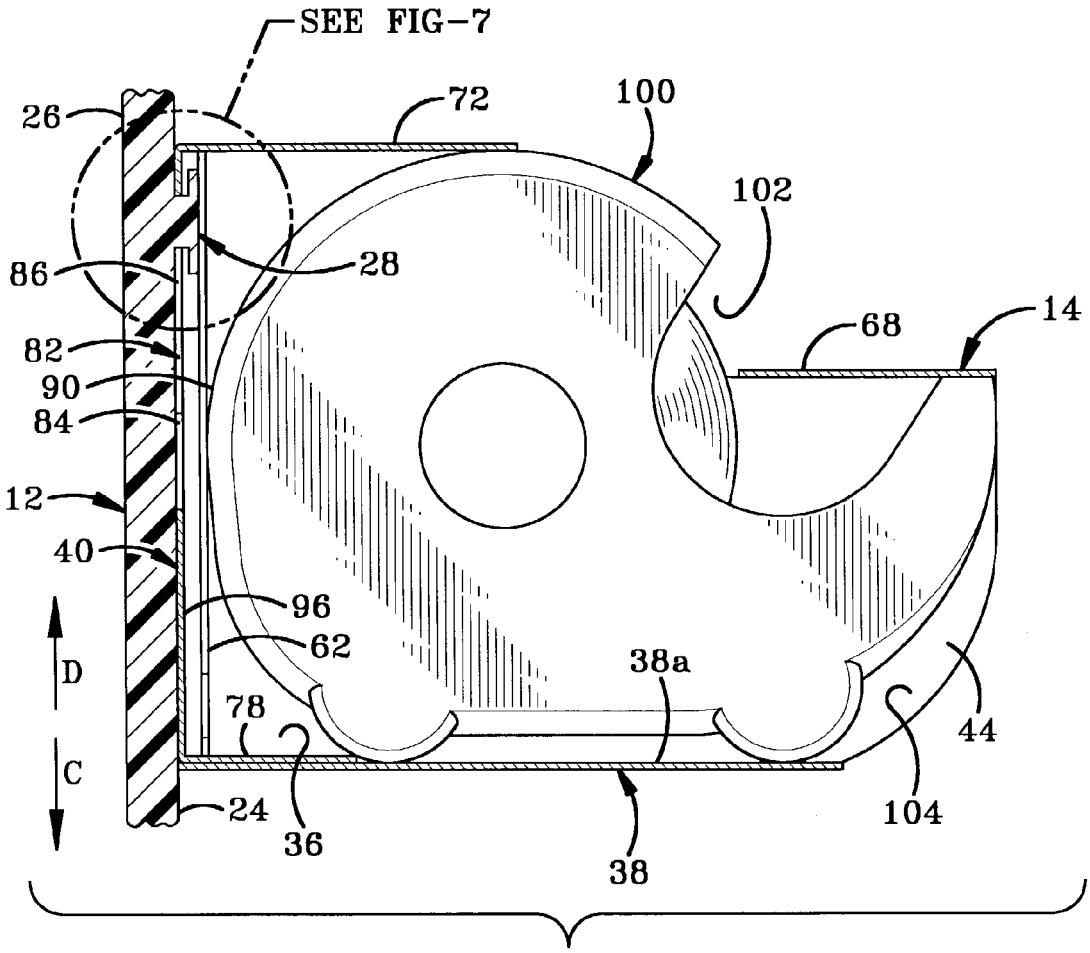
FIG. 6 is a partial cross-sectional side view of the package fully engaged with the display board.
Figure 7:
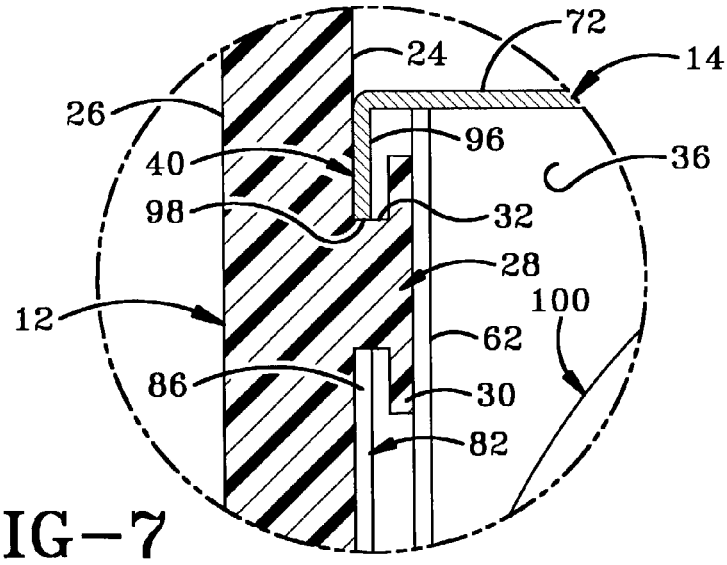
FIG. 7 is a close up of the peg from the display board fully engaged in the slot in the package.

When a user desires to remove a package 14 from display board 12, the process is simply reversed. The package 14 is grasped and moved upwardly in the direction of Arrow D (FIGS. 5&6). This causes the shaft 32 to move out of engagement with end 98 of slotted area. The upward movement continues until head piece 30 lies in proximity of rounded area 84. Package 14 is then moved in the direction of Arrow B (FIG. 4) until head piece 30 slips out of rounded area 84. Package 14 is then freed from display board 12. If the consumer decides not to purchase the product 100, the can quickly and easily replace the package 14 back onto the display board 12 by reinserting the head piece 30 into rounded area and allowing the package to move downwardly in the direction of Arrow C.

Figure 14:
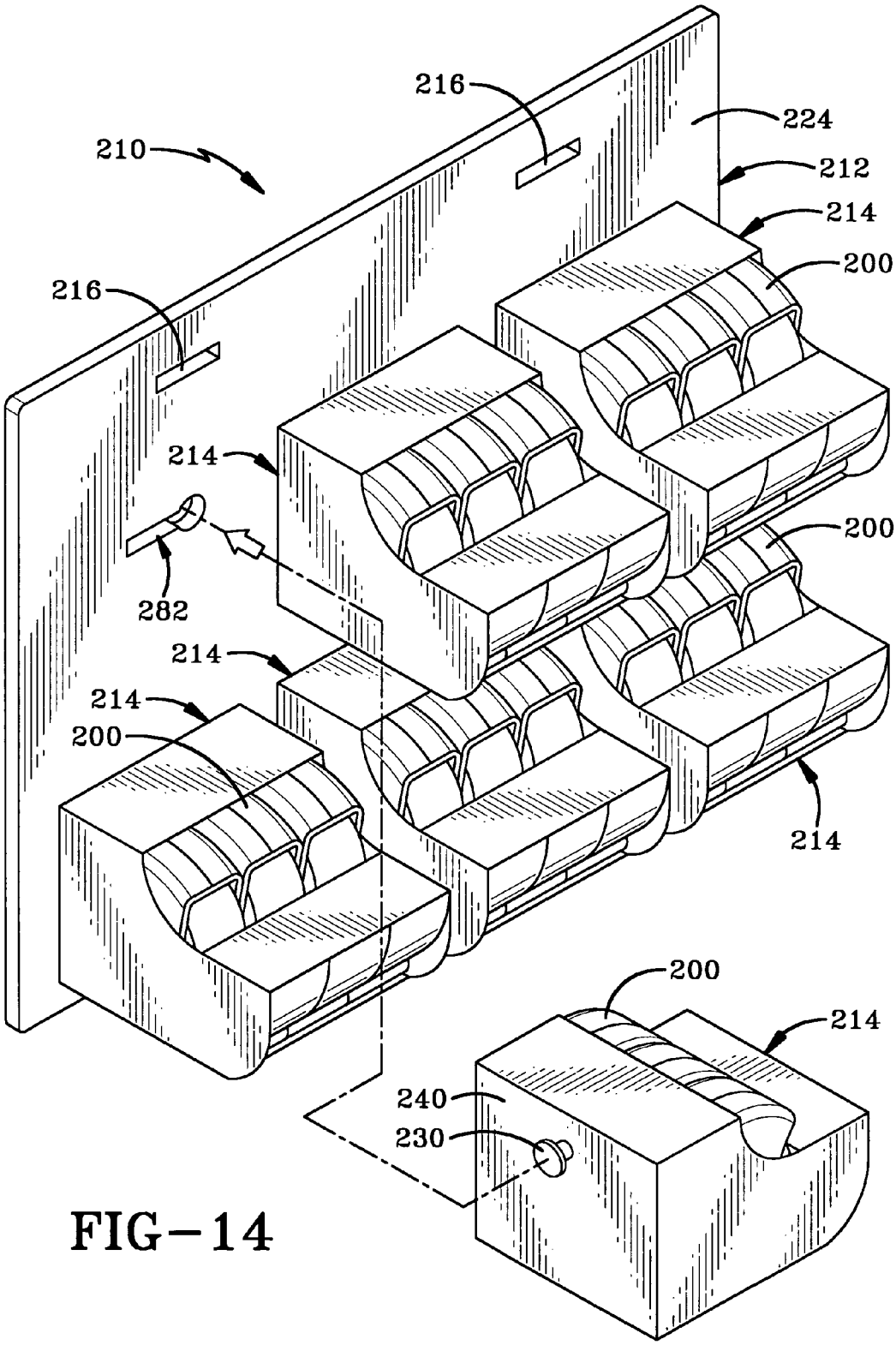
FIG. 14 is a perspective view of a second embodiment of a display system in accordance with the present invention showing the display board and the packages for engagement thereon.

While it has been disclosed that the pegs or buttons 30 are disposed on display board 12 and the keyhole slots 82 are disposed on the packages 14, it will be understood by those skilled in the art that the pegs 30 could be disposed on the packages 14 and the keyhole slots 82 could be formed on display boards 12, without departing from the spirit of the present invention. This second embodiment of the invention is shown in FIG. 14, where packages 214 have a button 230 formed on rear side 240 thereof; and display board 212 includes a plurality of keyhole slots 282. As with the previous embodiment, the packages 214 of products 200 are secured to display board 212 by engaging buttons 230 in keyhole slots 282. Keyhole slots are oriented so as to allow packages 214 to held on display board 212 by gravity. Display board 212 may be hung from a display unit (not shown) by inserting hooks (not shown) through holes 216 in board 212.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

What is claimed is:

1. A display system for retail packaging, said display system comprising:

a display board;

a packaging blank, said blank having predetermined fold lines, whereby said blank is folded about said fold lines to form a folded packaging blank having an interior cavity, said blank being adapted to be folded directly around a retail product, whereby said retail product is held within said cavity;

a peg extending from one of said display board and packaging blank, said peg having a shaft of a first width and a head of a second width, said first width being smaller than the second width;

a keyhole slot disposed in the other of said display board and packaging blank, the keyhole slot having a wide end and a narrow end; the wide end being substantially the same size as the head of the peg and the narrow end being substantially the same size as the shaft of the peg; whereby the head is receivable through the wide end of the slot and the folded packaging blank is moved relative to the display board so that the head engages the narrow end of the slot thereby connecting the package to the display board.

2. The display system as set forth in claim 1, wherein the board has a front and a rear and the peg extends forwardly from the front of the board.

3. The display system as set forth in claim 2, wherein the peg is integrally formed with the display board.

4. The display system as set forth in claim 2, wherein the head of the peg is substantially circular.

5. The display system as set forth in claim 4, further comprising a plurality of pegs disposed in generally parallel rows at spaced intervals across the display board; and a plurality of folded packaging blanks for engagement therewith; each of the blanks being provided with a keyhole slot formed therein; whereby each folded packaging blank is engaged with one of the pegs extending from the display board.

6. The display system as set forth in claim 5, wherein a plurality of folded packaging blanks are displayed on the display board, each folded packaging blank engaging one of the pegs in a row.

7. The display system as set forth in claim 6, wherein the folded packaging blanks are adapted to hold a plurality of adhesive tape dispensers therein.

8. The display system as set forth in claim 1, wherein the packaging blank comprises:

a base onto which the retail product is placed;

a side area disposed on either side of the base, the side areas being foldable into engagement with the sides of the product;

a rear wall connected to one of said side areas, the rear wall being foldable into engagement with the rear of the product;

a plurality of tabs extending from the side areas and rear wall, the tabs being adapted to be joined together when the side areas and rear wall are folded into engagement with the product, whereby the product is confined within the folded blank.

9. The display system as set forth in claim 1, wherein the packaging blank comprises;

a base having a front edge, a rear edge and opposing side fold lines, said base being adapted to receive a product thereon;

a first and a second side section extending outwardly from the base whereby one of the side fold lines lies between each of said first and second side sections and said base; and wherein said first and second side sections each have a rear fold line, a front edge and a first and second side fold line;

a first tab extending outwardly from the rear fold line of each of said first and second side sections;

a second tab extending outwardly from the first side fold line of each of the first and second side sections;

a third tab extending outwardly from the second side fold line of each of the first and second side sections;

a rear wall extending outwardly from one of the third tabs; and wherein said rear wall has a rear fold line disposed opposite the third tab;

a keyhole slot formed in the rear wall; and a fourth tab extending outwardly from the rear fold line of the rear wall; whereby the blank may be folded along all fold lines to form a generally cubic package having a cavity formed therein and being adapted to hold a product within the cavity.

10. The display system as set forth in claim 9, wherein the second tabs of the first and second side sections are glued together.

11. The display system as set forth in claim 10, wherein the third tabs of the first and second side sections are glued together.

12. The display system as set forth in claim 11, wherein the base is rectangular in shape.

13. The display system as set forth in claim 12, wherein the rear wall is rectangular in shape.

14. The display system as set forth in claim 13, wherein the folded blank defines a first window through which the product is viewable.

15. The display system as set forth in claim 14, wherein the folded blank defines a second window through which the product is viewable.

16. The display system as set forth in claim 15, wherein the first and second windows are vertically disposed one above the other.

17. The display system as set forth in claim 1, wherein said folded packaging blank has an upper edge and said display board has an upper edge; and wherein the wide end of the keyhole slot is disposed below the narrow end of the keyhole slot relative to the upper edge of the one of the display board and folded packaging blank in which the slot is defined.

18. The display system as set forth in claim 17, wherein the folded packaging blank is held in place on the display board by gravity when the peg is engaged in the narrow end of the keyhole slot.

19. In combination:

a product to be offered for sale;

a packaging blank having a plurality of predetermined fold lines and being foldable about the fold lines and around the product to form a folded blank with the product secured therein;

a keyhole shaped slot provided in a rear wall of the folded blank; wherein the slot has a narrow end and a wide end and the wide end is disposed below the narrow end relative to a top surface of the folded blank;

a display board having a front surface;

a peg extending outwardly from the front surface of the board and terminating in an enlarged head; wherein the peg head is smaller than the wide end of the keyhole slot and is wider than the narrow end of the keyhole slot; and wherein the peg is selectively receivable in the keyhole slot between a first position where the folded blank is receivable onto or removable from said display board, and a second position where a shaft of the peg is disposed within the narrow end of the keyhole slot and the folded blank is secured to the display board.

20. The combination of claim 19, wherein the folded blank is maintained in the second position on the display board by gravity and is free of any additional securing devices.

* * * * *